US007418764B2

(12) United States Patent
Gordon et al.

(10) Patent No.: US 7,418,764 B2
(45) Date of Patent: Sep. 2, 2008

(54) MODE CONTROL ARRANGEMENT FOR A FLOOR CARE APPLIANCE

(75) Inventors: Evan A. Gordon, Canton, OH (US); Kenneth H. Cooper, Akron, OH (US); Andrew C. Budd, Clinton, OH (US); Jack S. Stayer, Greentown, OH (US)

(73) Assignee: The Hoover Company, North Canton, OH (US)

( * ) Notice: Subject to any disclaimer, the term of this patent is extended or adjusted under 35 U.S.C. 154(b) by 208 days.

(21) Appl. No.: 11/398,317

(22) Filed: Apr. 5, 2006

(65) Prior Publication Data

US 2007/0234505 A1 Oct. 11, 2007

(51) Int. Cl.
*A47L 5/34* (2006.01)

(52) U.S. Cl. ..... 15/354; 15/390; 15/391

(58) Field of Classification Search ..... 15/354, 15/390, 391, 355, 356
See application file for complete search history.

(56) References Cited

U.S. PATENT DOCUMENTS 4,446,594 A * 5/1984 Watanabe et al. ..... 15/323
4,706,327 A 11/1987 Getz et al.
5,056,175 A 10/1991 Stein et al.
5,331,715 A 7/1994 Johnson et al.
5,467,502 A 11/1995 Johnson et al.
5,537,712 A 7/1996 Weber et al.
5,768,746 A 6/1998 Kamatani et al.
6,098,243 A 8/2000 Kim
6,158,084 A * 12/2000 Weber et al. ..... 15/390
7,203,993 B2 * 4/2007 Tondra et al. ..... 15/362
2004/0211027 A1 * 10/2004 Park et al. ..... 15/354
2006/0070209 A1 * 4/2006 Fischer et al. ..... 15/354

* cited by examiner

*Primary Examiner*—Joseph J. Hail, III
*Assistant Examiner*—Robert Scruggs
(74) *Attorney, Agent, or Firm*—Renner, Kenner, Greive, Bobak, Taylor & Weber

(57) ABSTRACT

An upright vacuum cleaner is provided having a suction nozzle height adjustment arrangement controlled by a rotary mode control member located on the upper housing. The rotary mode control member controls a suction nozzle height adjustment motor and a rotary agitator drive disconnect arrangement. A wheel tensioner located on an idler arm is operatively connected to a cam on the suction nozzle height adjustment motor which tensions and de-tensions the agitator drive belt to control the rotary agitator. The rotary mode control member could have discrete settings for the various floor surfaces to be cleaned including bare floors and carpet of varying pile heights. Alternately, the rotary mode control member could be variable so that an infinite number of suction nozzle height settings can be selected.

8 Claims, 9 Drawing Sheets

MODE CONTROL ARRANGEMENT FOR A FLOOR CARE APPLIANCE

FIELD OF THE INVENTION

Generally, the invention relates to vacuum cleaners. Particularly, the invention relates to a rotary mode control arrangement for a floor care appliance such as an upright vacuum cleaner.

BACKGROUND OF THE INVENTION

It is known to produce an upright vacuum cleaner with controls for controlling the operation of the motor-fan assembly, the height of the suction nozzle in relation to the floor surface, and for turning the rotary agitator on and off. There are many such cleaners having various manual or electronic controls or a combination thereof for controlling these features individually or in conjunction with one another as a system according to pre-determined settings.

In recent years, it has been found to be advantageous to produce a floor care appliance with one or more modes wherein one of the modes will be used for cleaning bare floors. In bare floor mode, it is desirous to either manually or automatically lower the suction nozzle of the vacuum cleaner to the lowest position in relation to the floor surface while simultaneously disconnecting the rotary power to the rotary agitator. Disconnecting the rotary agitator prevents the rotating agitator from damaging the floor surface. It has also been found to be desirous to vary the height of the suction nozzle according to the type of floor surface being cleaned by utilizing a rotary control dial or member having either discrete settings or variable positions. In this manner, a suction nozzle height setting may be selected according to the type floor surface or type of carpet to be cleaned. Heretofore, it is unknown to have a floor care appliance utilizing a rotary control member to control the height of the suction nozzle and to control the rotary agitator according a pre-determined position of the rotary control member In the present invention, a rotary mode control member electronically controls a suction nozzle height adjustment motor. The suction nozzle height adjustment motor has a cam portion which adjusts the height of the suction nozzle by urging against a lever arm on the wheel carriage supporting the suction nozzle on the floor surface. A projection extending from the cam portion is operatively linked to an idler arm having a belt tensioner for tensioning and de-tensioning the agitator drive belt according to a pre-determined height of the suction nozzle. Thus, the rotary control member can be moved to a position to lower the suction nozzle closest to the floor surface and turn off the rotary agitator ortho other positions where the suction nozzle is moved to a pre-determined height above the floor surface and the drive belt is tensioned so that rotary power is provided to the rotary agitator. Therefore, the present invention fulfills a need not heretofore addressed in the prior art.

SUMMARY OF THE INVENTION

In carrying out the invention in one aspect thereof, these objectives and advantages are obtained by providing a floor care appliance such as vacuum cleaner having a rotary mode control member located on the upper housing for controlling the height of the suction nozzle and to control the rotary agitator according to a pre-determined position of the rotary control member. The rotary mode control member includes a first position for cleaning bare or hard floors wherein the suction nozzle is lowered to the closest position in relation to the floor surface and the rotary agitator is turned off. The rotary mode control member also includes a second position for cleaning deep pile height carpet wherein the suction nozzle is raised to the highest position in relation to the floor surface and the rotary agitator is turned on. The rotary mode control member also includes one or more positions between said first and second positions for moving the suction nozzle to the proper height for cleaning carpet of various pre-determined pile heights and wherein the rotary agitator is turned on. The rotary mode control member is operatively linked to a suction nozzle height adjustment motor which raises and lowers the suction nozzle according to the position of the rotary mode control member. A cam portion extending from the suction nozzle height adjustment motor urges against a lever arm extending from the wheel carriage supporting the suction nozzle for raising and lowering the suction nozzle. A projection also extends from said cam portion for engaging an idler arm which has a wheel tensioner extending therefrom for tensioning and de-tensioning a drive belt transmitting rotary power from the motor-fan assembly to the rotary agitator. The projection urges said lever arm to cause said wheel tensioner away from said drive belt when said suction nozzle is moved to the lowest or bare floor position. This causes the rotary power from said motor-fan assembly to be disconnected from said rotary agitator. The idler arm and wheel tensioner are released when said suction nozzle is moved to one of the other pre-determined positions by moving said rotary mode control member. The rotary mode control member is operatively connected to a microprocessor which is pre-programmed with data for controlling said suction nozzle height adjustment motor to one of the pre-determined height positions.

BRIEF DESCRIPTION OF DRAWINGS

Embodiments of the invention, illustrative of several modes in which applicants have contemplated applying the principles are set forth by way of example in the following description and are shown in the drawings and are particularly and distinctly pointed out and set forth in the appended claims.

DESCRIPTION OF THE PREFERRED EMBODIMENT

Figure 1:
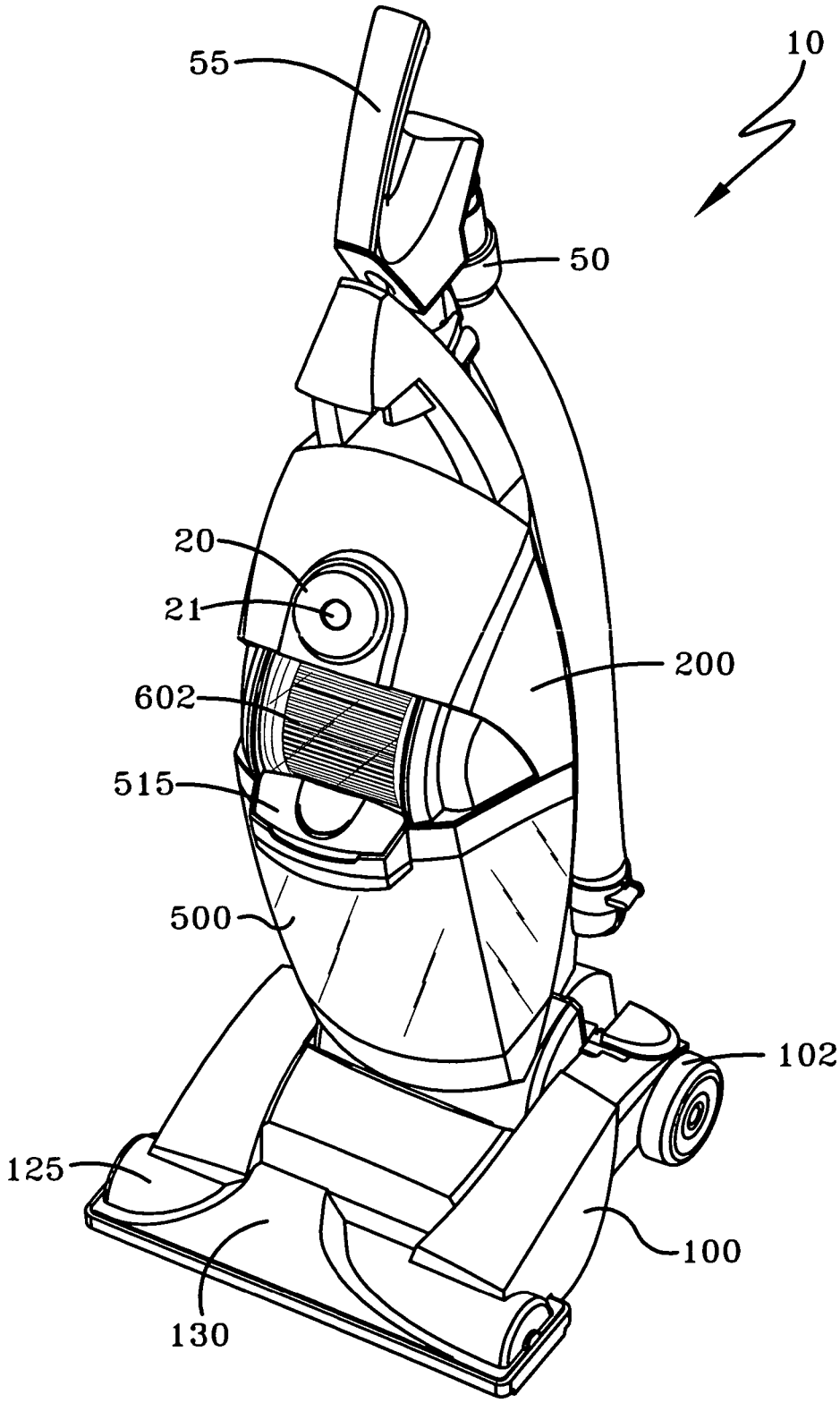
FIG. 1 is a perspective view of an upright vacuum cleaner, according to the preferred embodiment of the present invention.

An upright vacuum cleaner 10 according to a preferred embodiment of the present invention is illustrated by way of example in FIG. 1. The vacuum cleaner 10 is of the type having a removable wand and hose assembly 50 for off-the-floor cleaning that when in the stored position, as shown in FIG. 1, also serves as a handle for manipulating the vacuum cleaner 10 over the floor surface. A cantilever style handgrip 55 extending from the free end of wand and hose assembly 50 is provided for allowing the user to manipulate the cleaner 10 over the floor surface. The hose and wand assembly 50 can also be removed from the rear of the housing 200 for cleaning in the off-the-floor mode. The hose and wand assembly 50 is telescoping for allowing for user's of differing height. Various cleaning accessories (FIG. 2) can be installed onto the suction end (not shown) of the hose and wand assembly 50 and stored in recesses on the rear of housing 200.

Referring now to FIGS. 1, 2, 2A, 2B, 3, 3A, 3B, 3C and 3D, the vacuum cleaner 10 is equipped with a dirt cup 500 which is fitted into a recess in the housing 200. The dirt cup 500 has a latch 515 fitted into a pre-filter 503 that sits in the top of the dirt cup 500 for securing the dirt cup 500 into the recess in the housing 200. The dirt cup 500 has a pivoting door 504 attached at the bottom for emptying the contents of the dirt cup for later disposal. The details of the dirt cup 500 are discussed more fully in detail hereinbelow.

Located immediately above the dirt cup 500 is a rotating filtration cartridge 602 that is visible through a translucent viewing window located in the front of a filtration housing 601. The rotating filtration cartridge 602 acts as a final filter for the dirt laden air stream flowing that originated through the suction openings 116 located beneath the suction nozzle 130. The motor-fan assembly 401 generates the suction that is applied to the suction nozzle 130 through the dirt cup 500 and filtration cartridge 602. The filtration cartridge 602 is rotated so that a single segregated, longitudinal portion of the hollow interior is rotated past a valve (not shown) which allows ambient air to reverse flow through that portion of the filtration cartridge 601. The ambient airflows through the filtration cartridge wall to clean the outer surface of the filtration cartridge wall for that portion of the filtration cartridge 602. As the filtration cartridge 602 rotates through one complete 3600 revolution, the exterior of the filtration cartridge 602 is cleaned of the buildup of dust and dirt. In this manner the filtration cartridge 602 is continuously cleaned and filtration performance is maintained. A similar regenerative filtration arrangement was disclosed in U.S. patent application Ser. No. 10/731,380 filed on Dec. 8, 2003, and U.S. patent application Ser. No. 11/249,249 filed on Oct. 13, 2005, both of which are incorporated by reference as if fully rewritten herein.

The vacuum cleaner 10 includes a foot 100 with a suction nozzle 130 attached at the front. The vacuum cleaner 10 is of the type having an agitator 135 positioned within an agitator chamber (not shown) formed in suction nozzle 130. The agitator chamber (not shown) communicates with the suction nozzle openings 116 and the agitator 135 rotates about a horizontal axis inside the agitator chamber (not shown) for loosening dirt from the floor surface. The loosened dirt is drawn into a suction duct 110*b* located behind and fluidly connected to agitator chamber (not shown) by a suction air stream generated by a motor-fan assembly 401. The suction duct 110*b* directs the loosened dirt to a dirt cup 500 positioned in the upper housing 200. Freely rotating support wheels 102 (only one of which is visible in FIG. 1) are located to the rear of the foot 100. In an alternate embodiment,the foot 100 could further include a transmission (not shown) and drive wheels (not shown)for propelling the vacuum cleaner 10 in a forward and reverse direction over a surface to be cleaned.

Located above the rotating filtration cartridge 602 is a rotary mode control member 20 for controlling the height of the suction nozzle 130 in relation to the floor surface and for disconnecting the rotary power to rotary agitator 135 for pre-selected suction nozzle 130 heights in relation to the floor surface. A push button member 21 is located in the center of the rotary mode control member 20 for switching the motor-fan assembly 401 on and off. Both the push button member 21 and rotary mode control member 20 are operatively connected to a control board 35 having electrical controls for controlling various features of the vacuum cleaner 10. The details of the rotary mode control member 20 and push button member 21 are shown in the exploded view shown in FIG. 2A. The rotary mode control member 20 and push button member 21 are mounted to the front side of an upper housing portion cover 205 which also serves as a housing for the filtration housing 601 described more fully hereinbelow. A variable switch or potentiometer 23 and an electrical switch 24 are mounted on a control board 22 which is located behind the upper housing portion cover 205. The rotary mode control member 20 is operatively connected to the potentiometer 23 for sending a signal of varying magnitude to the control board 35 to adjust the suction nozzle height according to the position of the potentiometer 23. The potentiometer 23 can have variable settings or be equipped with discrete settings such as those shown in FIG. 2B including high, medium, low and hard floor settings. The push button member 21 is operatively connected to a power switch 24 mounted the control board 35 for switching the power to the motor-fan assembly 401 on and off.

The rotary agitator 135 is supplied rotary power through a drive belt 142 which is tensioned and de-tensioned to connect and disconnect the rotary power according to the position of the rotary mode control member 20 selected by the user. The drive belt 142 is supplied rotary power by a pulley 145 which is driven by a v-grooved belt 147 that engages an upper portion 145*b* of the pulley 145. The v-grooved belt 147 coupled to a grooved portion of stub shaft 401*a* extending from motor-fan assembly 401. A grooved portion 145*a* of pulley 145 receives the drive belt 142 connected to rotary agitator 135.

In the preferred embodiment of the invention, the mode control member 20 is electronically connected to a suction nozzle height adjustment motor 140 which varies the height of the suction nozzle 130 and foot 100 in relation to the surface to be cleaned. For pre-selected suction nozzle 130 height positions, such as for cleaning bare or hard floors, it may be desirous to disconnect connect the rotary power to the rotary agitator 135. This is accomplished by a projection or tongue 140*b* extending from a cam portion 140*a* extending downwardly from the suction nozzle height adjustment motor 140. The tongue 140*b* causes idler arm 141 to be rotated so a tensioner wheel 143 normally tensioning drive belt 142 is released and drive belt 142 is de-tensioned causing rotary agitator 135 to stop rotating. Oppositely, it may be desirous to connect the rotary power to the rotary agitator 135 when returning to cleaning floors having carpet. Moving the mode control member to one of the discrete positions for cleaning carpet causes the suction nozzle height adjustment motor 140 to rotate the tongue 140*b* extending from cam portion 140*a* to release the pressure against idler arm 141 causing tensioner wheel 143 to return to the normal position and once again the tension drive belt 142 causing rotary agitator 135 to stop rotating. A torsional spring 146 biases the idler arm 141 back to the normal position to tension drive belt 142 to cause rotary agitator 135 to rotate.

Figure 2:
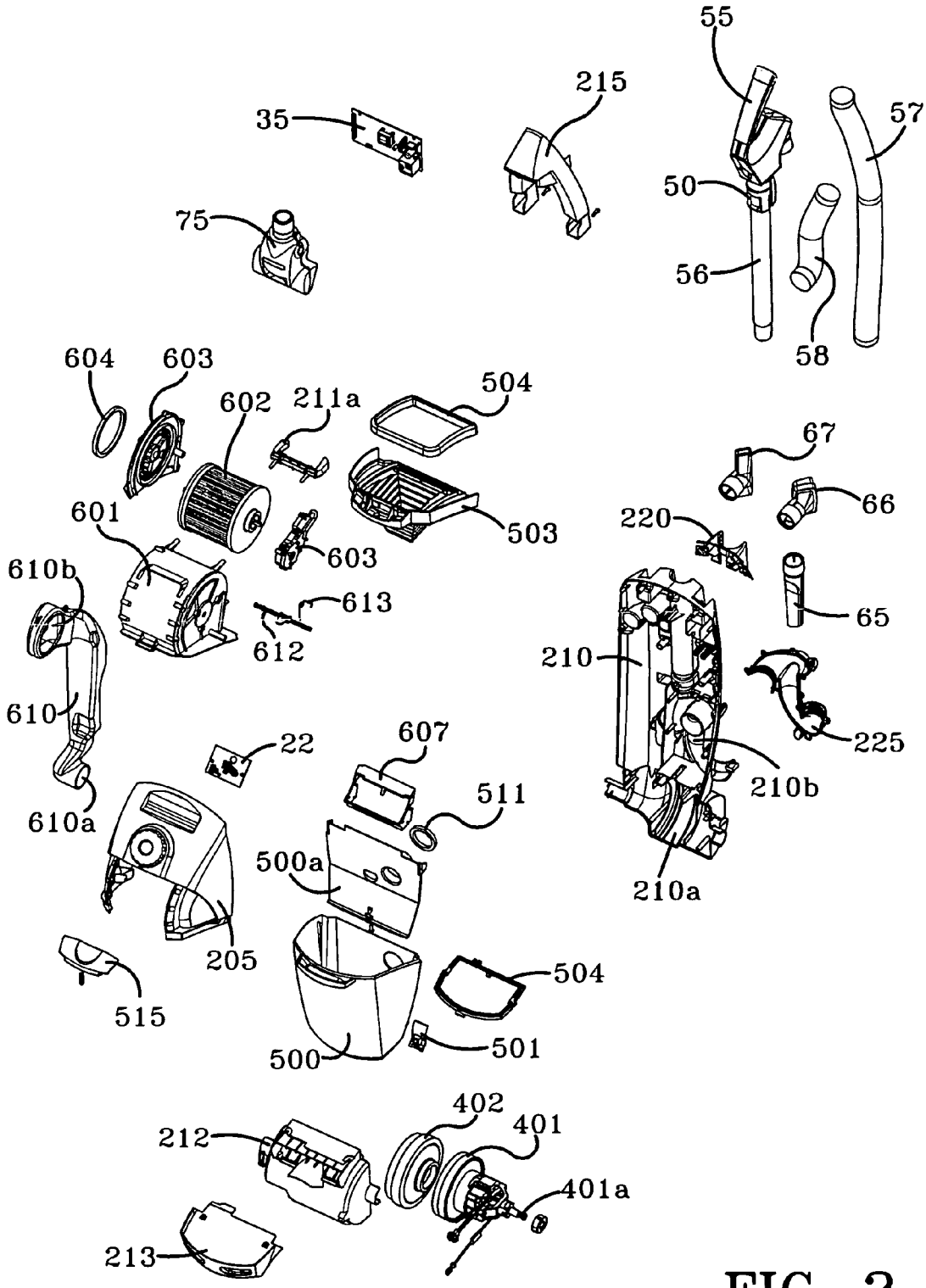
FIG. 2 is an exploded view of an upper portion the vacuum cleaner of FIG. 1, according to the preferred embodiment of the present invention.
Figure 2A:
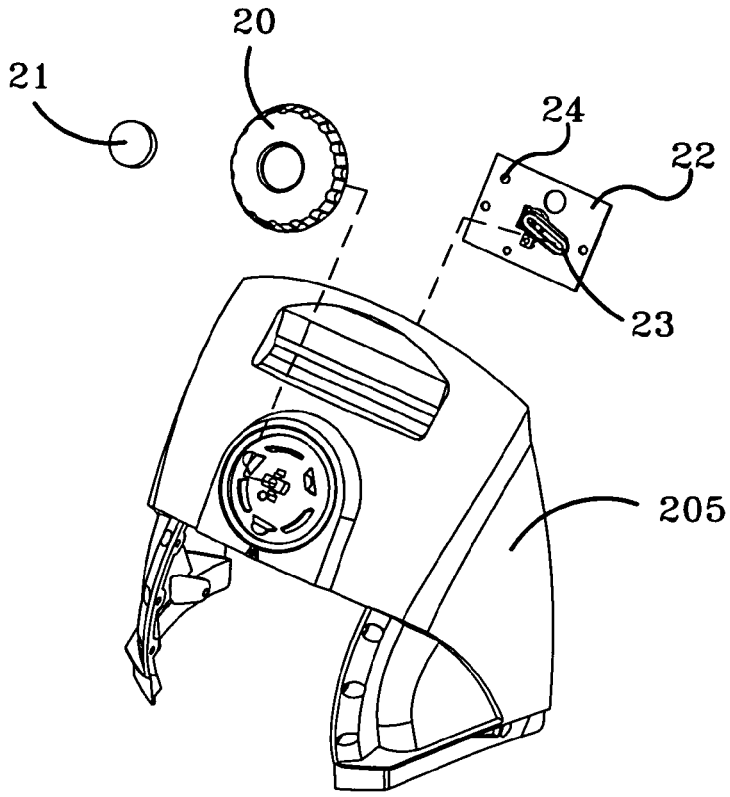
FIG. 2A is an exploded view of a portion of the upper housing of the vacuum cleaner of FIG. 1 showing the detail of the mode control arrangement; according to the preferred embodiment of the present invention.
Figure 2B:
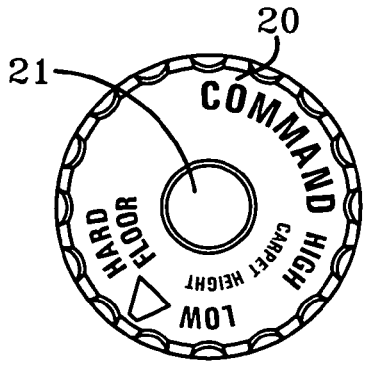
FIG. 2B is a front view of a cutaway portion of the mode control knob for the vacuum cleaner of FIG. 1, according to the preferred embodiment of the present invention.

Referring now to more particularly to FIG. 2, an exploded view of the upper housing of the vacuum cleaner 10 is shown. An upper housing shell 210 has a motor cavity 210*a* at the bottom for receiving the motor-fan assembly 401. A motor cover 212 secures motor-fan assembly 401 into motor cavity 210*a* in upper housing shell 210. A motor seal 402 located between the inlet side of motor-fan assembly 401 and the suction inlet end 610*a* of clean air duct 610. The suction outlet end 610*b* is then connected to the filter housing cover 603*a* of filter housing 601. A gasket 604 ensures a seal between filter housing cover 603*a* of filter housing 601. Suction from motor-fan assembly 401 is then delivered to filter housing 601. An electric motor 603 rotates filtration cartridge 602 so that a portion of filtration cartridge 601 is at all times subjected to a reverse flow of air flowing therethrough to remove the buildup of dust on the outer surface. The filtration cartridge 602 is partitioned on the hollow interior in the longitudinal direction and as the filtration cartridge 602 rotates a single longitudinal portion at a time is exposed to the ambient atmosphere through a special valve causing a reverse flow through that portion of the filtration cartridge 601. The remaining portions of the filtration cartridge 601 have an air stream flowing therethrough in the opposite direction. A filter partition 607 serves as a pressure barrier between the portion of the outer filter being cleaned by the reverse flow and the remaining portions of the outer filter that are filtering finer dirt particles from the dirt laden air stream.

The suction delivered to the filter housing 601 causes a pressure drop in the forward portion of the dirt cup 500 to draw a dirt laden air stream into the dirt cup 500 originating at the suction nozzle inlets 116 located below suction nozzle 130. A flexible duct portion 58 connects the suction duct 110*b* and 130*a* to the dirt cup 500 via another duct formed from a duct portion 210*b* integrally formed in the rear of upper housing shell 210 and a duct cover 225. A gasket 511 seals the duct portion 210*b* to the dirt cup inlet 500*e* (FIG. 4A). The dirt cup 500 has a partition 500*a* separating dirt cup 500 into a front portion and a rear portion. The front portion is for collecting debris collected from the suction nozzle 130 as previously described. The rear portion is for collecting debris removed from filtration cartridge 602 during the cleaning operation. The partition 500*a* serves to operate as a pressure barrier between the suction delivered to the front portion of dirt cup 500 from motor-fan assembly 401 and the air at ambient pressure causing reverse flow through filtration cartridge 602. A flicker 612 is mounted in filtration housing 601 and in operative engagement with filtration cartridge 602 to vibrate the pleated edges of filtration cartridge 602 to aid in the removal of dust buildup. A spring 612*a* biases the flicker 612 against filtration cartridge 602.

A pre-filter basket 503 is inserted into the open top of dirt cup 500 for filtering larger dirt particles and retaining them in the front portion of dirt cup 500. The pre-filter basket 503 is of a truncated pyramidal shape that extends downwardly into the front portion of dirt cup 500. A plurality of vertical axis holes in pre-filter basket 503 allow the cleaning suction to be delivered to the front portion of dirt cup 500 from filtration housing 601. The more finer dust is then filtered from the dirt laden air stream by filtration cartridge 602. A pre-filter basket gasket 504 seals the pre-filter basket 504 against the filtration housing.

A carrying handle 215 is provided above the upper housing portion cover 205 for carrying the vacuum cleaner 10 up the stairs and the like. A suction powered hand tool 75 can be stored in a pocket partially formed from the carrying handle 215. One or more off-the-floor accessory tools including a crevice tool 65, dusting brush assembly 66, and furniture nozzle 67 can be stored in pockets integrally formed in the rear of upper housing shell 210. The free end of the telescoping portion 56 of wand assembly 56 fits over a post (not shown) on the rear of upper housing shell 210 for sealing off the suction. The handle portion 55 is connected to a flexible hose portion 57 which is connected to the duct portion 225 on the rear of upper housing shell 210. Thus, cleaning suction is delivered to the wand assembly 50 or the suction nozzle 130 as previously described. The wand assembly 50 slides into a set of grooves (not shown) formed in the rear of upper housing shell 210 and is secured by a latch 220 which is depressed to release wand assembly 50 for off-the-floor use.

Figure 3:
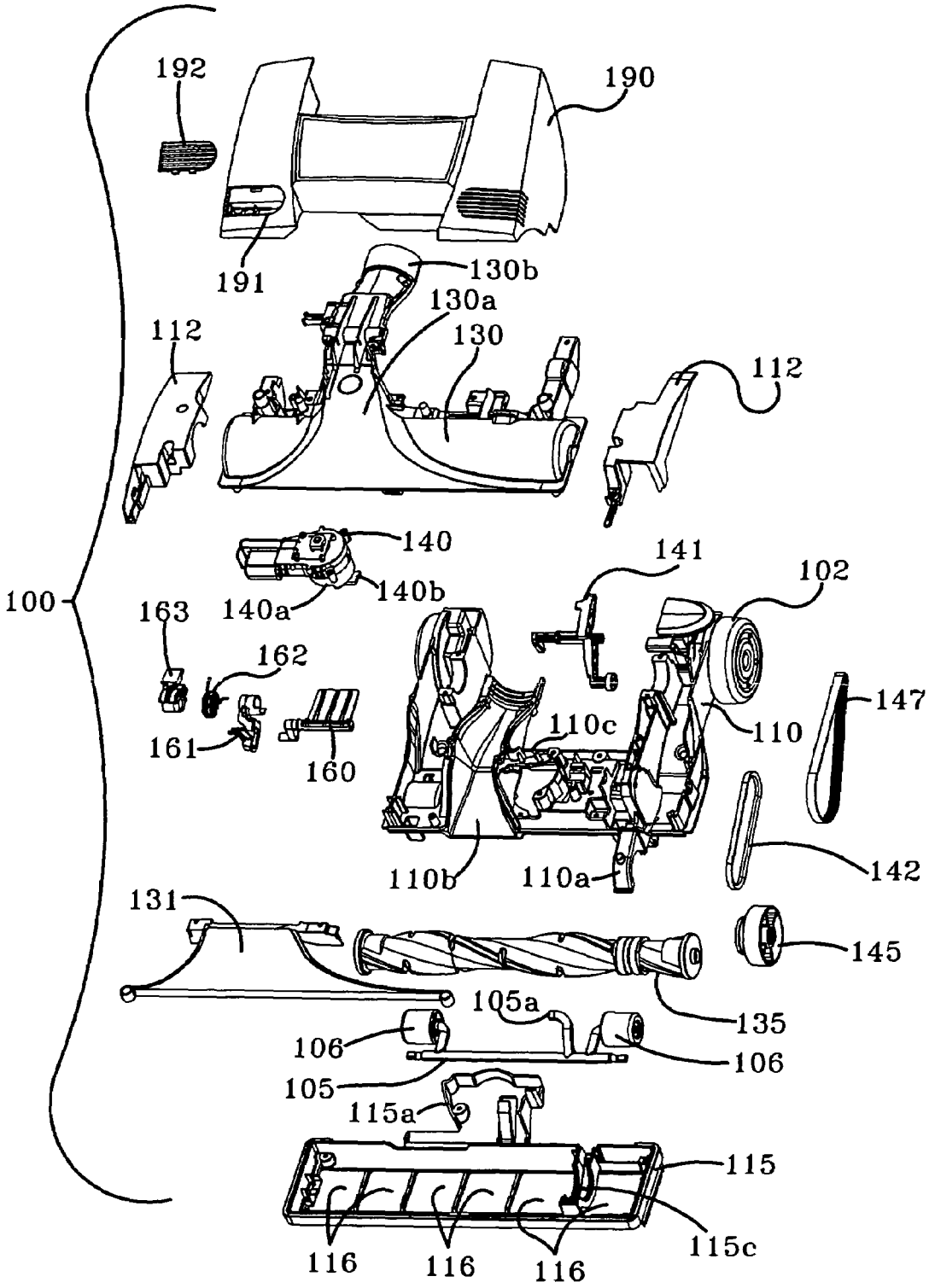
FIG. 3 is an exploded view of a foot portion of the vacuum cleaner of FIG. 1, according to the preferred embodiment of the present invention.

FIG. 3, shown is an exploded view of the foot 100 of the upright vacuum cleaner 10 shown in FIG. 1. The foot 100 is comprised of a base 110 which the remaining portions of the foot 100 are assembled to. A pair of rear wheels 102 are mounted on the rear for supporting the base 110 as it is propelled over the floor surface. A suction duct is partially formed from a channel 110*b* integrally formed on the upper surface of the base 110. The suction duct is also partially formed from a channel 130*a* integrally formed in a suction nozzle 130 that is mounted on top of and partially extending from the front of the base 110. The suction nozzle 130 also has an agitator chamber wherein the rotary agitator 135 is installed for loosening dirt from the floor surface. A suction nozzle liner 131 fits into the upper surface of the agitator chamber formed in the suction nozzle 130 to complete the suction duct 130*a* extending from the forward edge of the agitator chamber and over the agitator chamber for directing the dirt laden air stream to the dirt cup 500 via the flexible suction duct 58. A similar suction nozzle configuration was disclosed in U.S. Pat. Nos. 5,513,418, 6,002,402, 6,237,189, and 6,772,475, all of which are owned by a common assignee and incorporated by reference as if fully rewritten herein. A more thorough description of the proposed suction nozzle for the subject cleaner was disclosed in U.S. provisional application No. 60/785,118 filed on Mar. 23, 2006 docketed as Hoover case 2839.

A bottom plate 115 fits to the bottom of suction nozzle 130 and has a plurality of suction inlets 116 formed therein for exposing the agitator 135 and suction nozzle 130 to the surface to be cleaned. A wheel carriage 105 with a pair of opposing wheels 106 fits into a channel 115*b* formed in a tongue 115*a* extending rearwardly from the bottom plate before the bottom plate 115 is installed on the underside of the agitator chamber. The wheel carriage 105 and wheels 106 support the front portion of the base 100 and suction nozzle 130 over the surface to be cleaned and is used to vary the height of the suction nozzle 130 over the surface to be cleaned by a lever arm 105*a* that extends from the wheel carriage 105. The lever arm 105*a* is in operative engagement with a cam 140*a* on the bottom of the suction nozzle height adjustment motor 140 which urges against the lever arm 105*a* causing the wheel carriage 105 to be raised or lowered. The bottom plate 115 has a belt guard 115*c* integrally formed therein for receiving the belt 142 that rotates the rotary agitator 135 and partially surrounds a portion of the bottom of the rotary agitator 135 having a groove for receiving the belt 142. The upper portion of the groove for receiving the belt 142 on rotary agitator is surrounded by a belt guard 110*a* that extends forwardly from base 110. The opposing end of belt 142 is inserted into a groove 145*a* (FIG. 3B) in pulley 145.

Figure 3A:
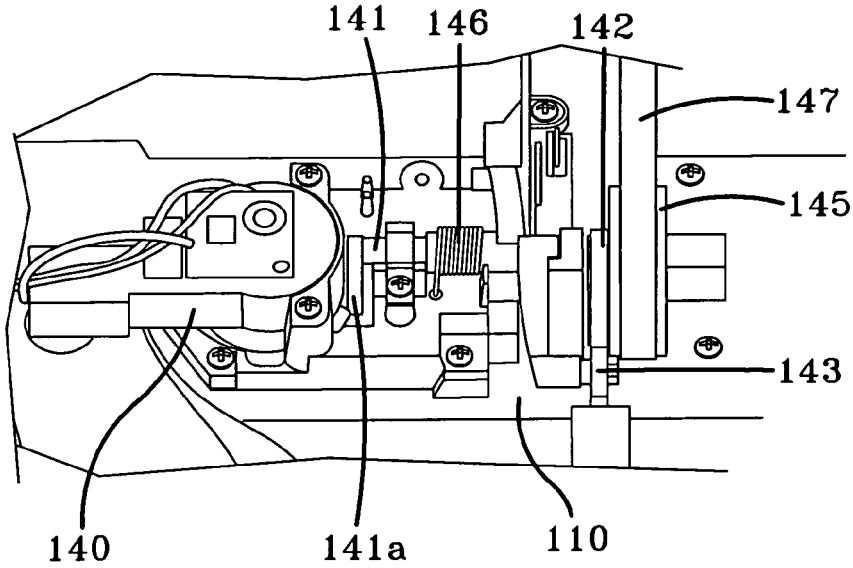
FIG. 3A is perspective view of the vacuum cleaner foot of FIG. 3 with the hood removed to show the suction nozzle height adjustment arrangement and the agitator drive disconnect arrangement, according to the preferred embodiment of the present invention.
Figure 3B:
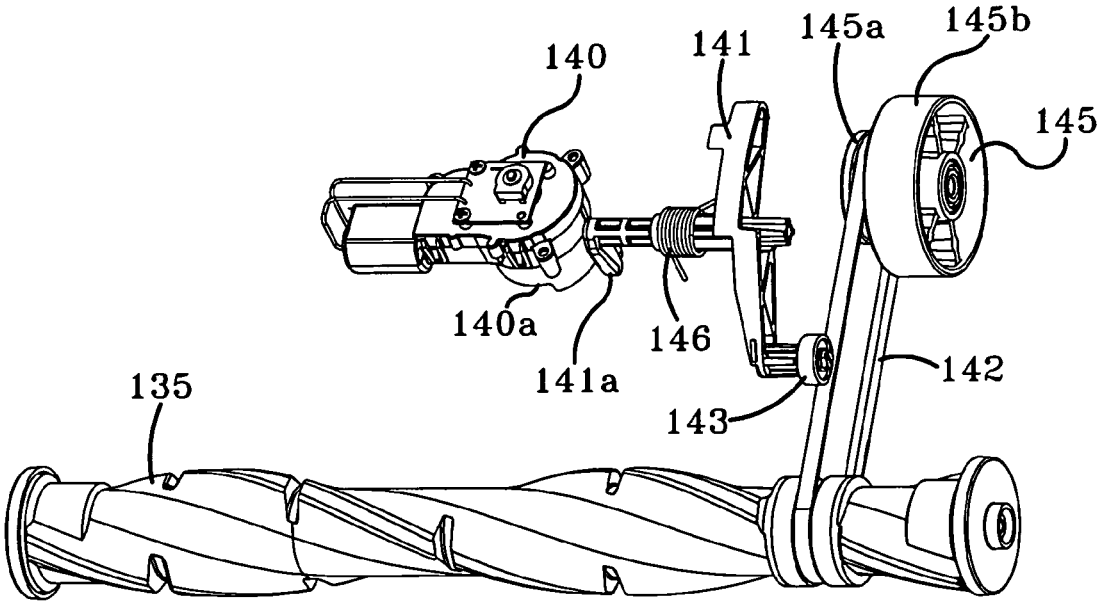
FIG. 3B is an enlarged perspective view of the automatic suction nozzle height adjustment and agitator drive disconnect arrangement removed from the foot portion shown in FIG. 3, according to the preferred embodiment of the present invention.

The suction nozzle height adjustment motor 140 is fitted into a recess 110*c* integrally formed in the upper surface of base 110 (see also FIG. 3A). A tongue 140*b* extending from the cam portion 140*a* of the suction nozzle height adjustment motor 140 engages an ear 141*a* on idler arm 141 causes idler arm 141 to rotate and remove the tension placed against drive belt 142 by the tensioner wheel 143 extending from idler arm 141. Idler arm 141 is otherwise biased by a torsional spring 146 such that the tensioner wheel 143 normally tensions drive belt 142 so that rotary agitator 135 rotates. It is desirable to de-tension drive belt 142 when the suction nozzle height adjustment motor 140 lowers the suction nozzle 130 to the position closest the floor surface for cleaning hard or bare floors. FIGS. 3A and 3B show the details of the suction nozzle height adjustment motor 140, idler arm 141, tensioner wheel 143, drive belt 142, rotary agitator 135 and pulley 145.

A valve 160 is installed in the suction duct 110*b* in the base 110 to cut off suction to the suction nozzle 130 when the upper housing 200 is in the upright or off-the-floor use position. This makes full suction available for off-the-floor cleaning via wand assembly 50 (FIG. 1). A front valve arm 161 is rotatably coupled to a rear valve arm 163 with a torsional spring 162 located therebetween for causing the valve 160 to be moved between the closed and open positions when upper housing 200 is moved from the upright or off the floor use position to the in use or floor cleaning position. The rear valve arm 163 is engaged by projection (not shown) on the upper housing 200 for causing front valve arm 161 to rotate valve 160 via a crank arm on valve 160 as the housing is moved between the upright or off the floor use position to the in use or floor cleaning position. The torsional spring 162 also causes the valve 160 to be normally biased into the closed position as when the housing 200 is normally in the upright position. A right trunnion cover 112 and left trunnion cover 112 pivotally secure the upper housing 200 to the base 110 (not shown). A hood 190 fits over the base 110 and suction nozzle 130 assembly. A recess 191 formed in hood 190 receives visual indicators for signaling the condition of the carpet or floor surface during cleaning to let the use know when dirt is being picked up and when the carpet is clean. A lens cover 192 fits over the recess 191 to cover recess 191 and the visual indicators.

Figure 3C:
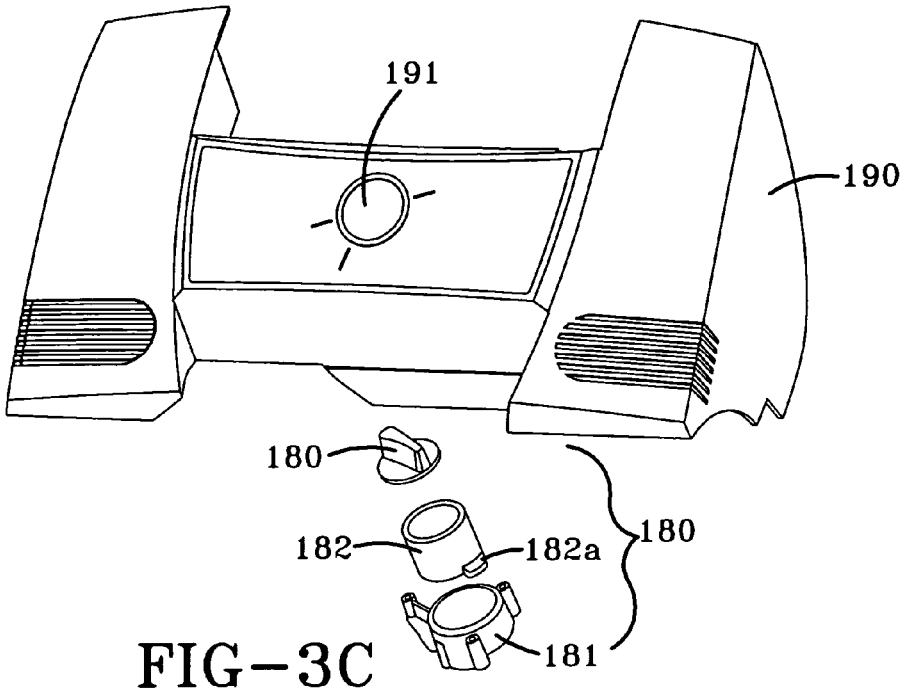
FIG. 3C is an exploded perspective view of the manual suction nozzle height adjustment and agitator drive disconnect arrangement, according to an alternate embodiment of the present invention.
Figure 3D:
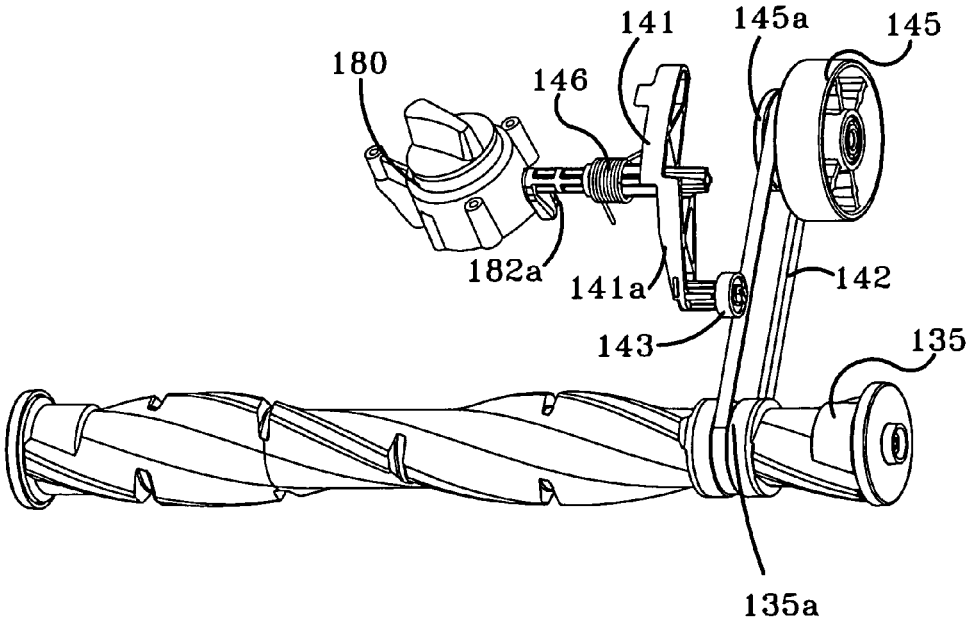
FIG. 3D is an enlarged perspective view of the manual suction nozzle height adjustment and agitator drive disconnect arrangement removed from the base portion shown in FIG. 3C, according to an alternate embodiment of the present invention.

In an alternate embodiment of the invention, and turning more particularly to FIGS. 3C and 3D, the suction nozzle height adjustment motor 140 of the preferred embodiment is replaced with a manual suction nozzle height adjustment arrangement 180 comprised of a knob 180, cam portion 182, and body portion 181. The knob 180 protrudes through an aperture 191 in hood 190 so a user can manually turn knob 180 to adjust the height of the suction nozzle 130. The cam portion 182 engages the lever arm 105*a* of wheel carriage 105 similar to the cam portion 140*a* of the suction nozzle height adjustment motor 140 does in the preferred embodiment. The rotary agitator 135 is also de-tensioned similarly by idler arm 141 when a projection or tongue 182*a* on cam portion 182 engages idler arm 141 when the manual suction nozzle height adjustment arrangement 180 is rotated to the bare or hard floor position. Rotating the tongue 182*a* against the ear 141*a* of idler arm 141 causes wheel tensioner 143 to be moved away from belt 142 causing belt 142 to remove the tension normally put on drive belt 142 by wheel tensioner 143. The loss of tension in drive belt 142 causes rotary agitator 135 to stop rotating. When tongue 182*a* is released from ear 141*a* of idler arm 141, the torsional spring 146 causes the idler arm 141 to be rotated back to the normal position and wheel tensioner 143 again causes belt 142 to be tensioned causing rotary agitator 135 to rotate.

Figure 4:
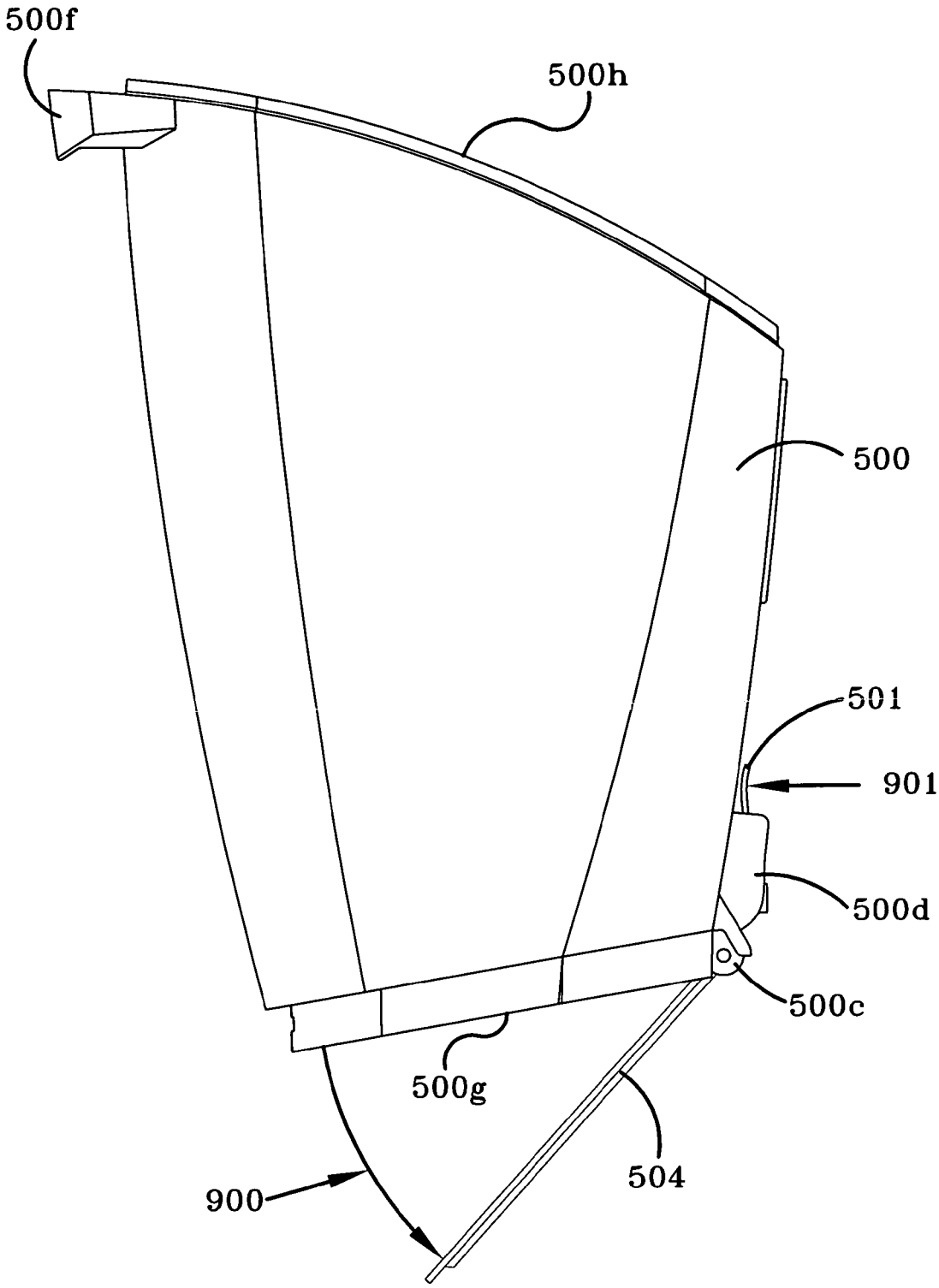
FIG. 4 is a side view of dirt cup for the vacuum cleaner of FIG. 1, according to the preferred embodiment of the present invention.
Figure 4A:
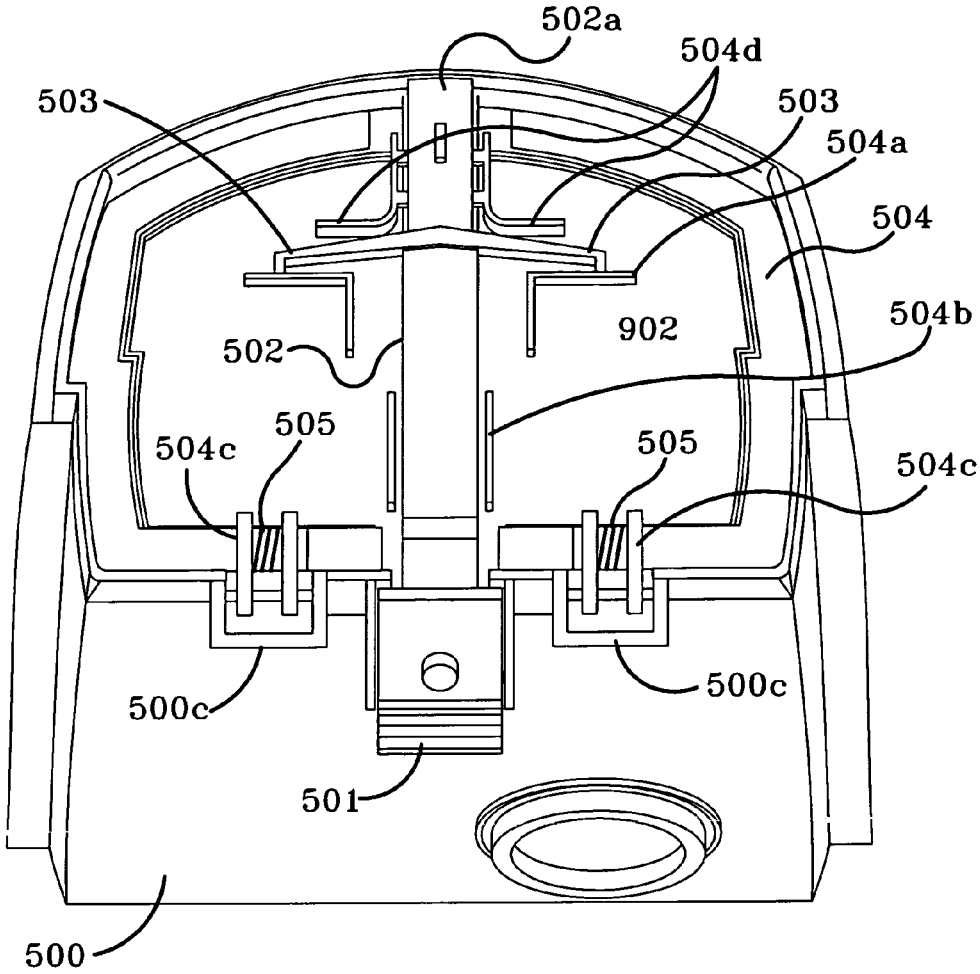
FIG. 4A is a bottom view of dirt cup of FIG. 4, according to the preferred embodiment of the present invention.
Figure 4B:
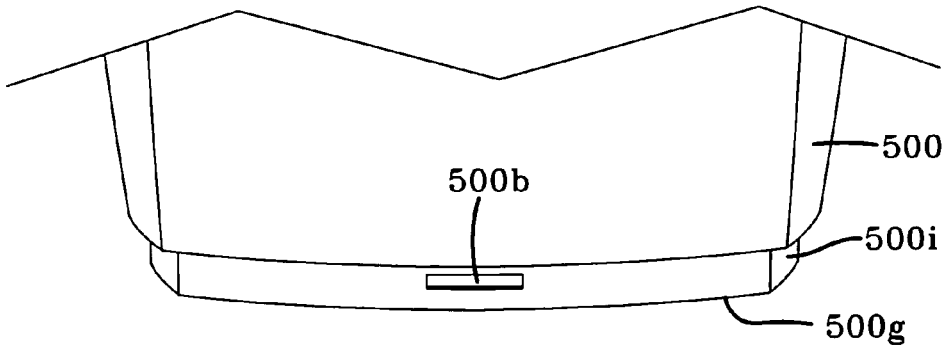
FIG. 4B is a cutaway front view of a portion of the dirt cup of FIG. 4, according to the preferred embodiment of the present invention.

Referring now to FIGS. 4, 4A and 4B, shown is a dirt cup 500 for a vacuum cleaner 10 as shown in FIG. 1. The dirt cup 500 has an opening 500*h* at the top and an opening 500*g* at the bottom. A pivoting lid 504 attached at the bottom prevents debris collected on the interior from falling out the bottom. The pivoting lid 504 opens by moving in the direction of arrow 900. A grip handle 500*f* is located at the front edge at the top of the dirt cup 500. The pivoting lid 504 is pivotally connected to one side of the bottom of the dirt cup 500 by hinges 500*c*. A release lever 500*d* is located directly above the hinges 500*c* for operating a sliding member 502 that traverses the underside of the dirt cup lid 504. One end of the sliding member 502 is connected to a lever 501 which pulls the sliding member 502 in the direction of arrow 902. A resilient portion 502*b* of sliding member 502 allows the sliding member 502 to flex around the bottom of the dirt cup 500 as the lever 501 is depressed in the direction of arrow 901. The free end of sliding member 502 comprises a tongue 502*a* which is disengaged from a groove 500*b* cut in the front sidewall of a rim portion 500*i* of dirt cup 500. The rim portion 500*i* of dirt cup 500 is for seating dirt cup 500 in the recess in upper housing 200. When tongue 502*a* is disengaged from groove 500*b* the lid 504 is free to pivot to the open position as shown in FIG. 4. Torsional springs 505 located in the hinges 500*c* attaching lid 504 to dirt cup 500 bias the lid into the open position when lever 501 is depressed. A pair of sidewall extending resilient members 503 return sliding member 502 to the normally closed position when lever 501 is released. The resilient members 503 urge against a pair of stops 504*a* located on the underside of lid 504. A pair of guides 504*d* on the underside of lid 504 guide the tongue 502*a* of sliding member 502 into groove 500*b* when lid 502 is moved to the closed position. Thus, lid 504 is latched until lever 501 is depressed.

Figure 5:
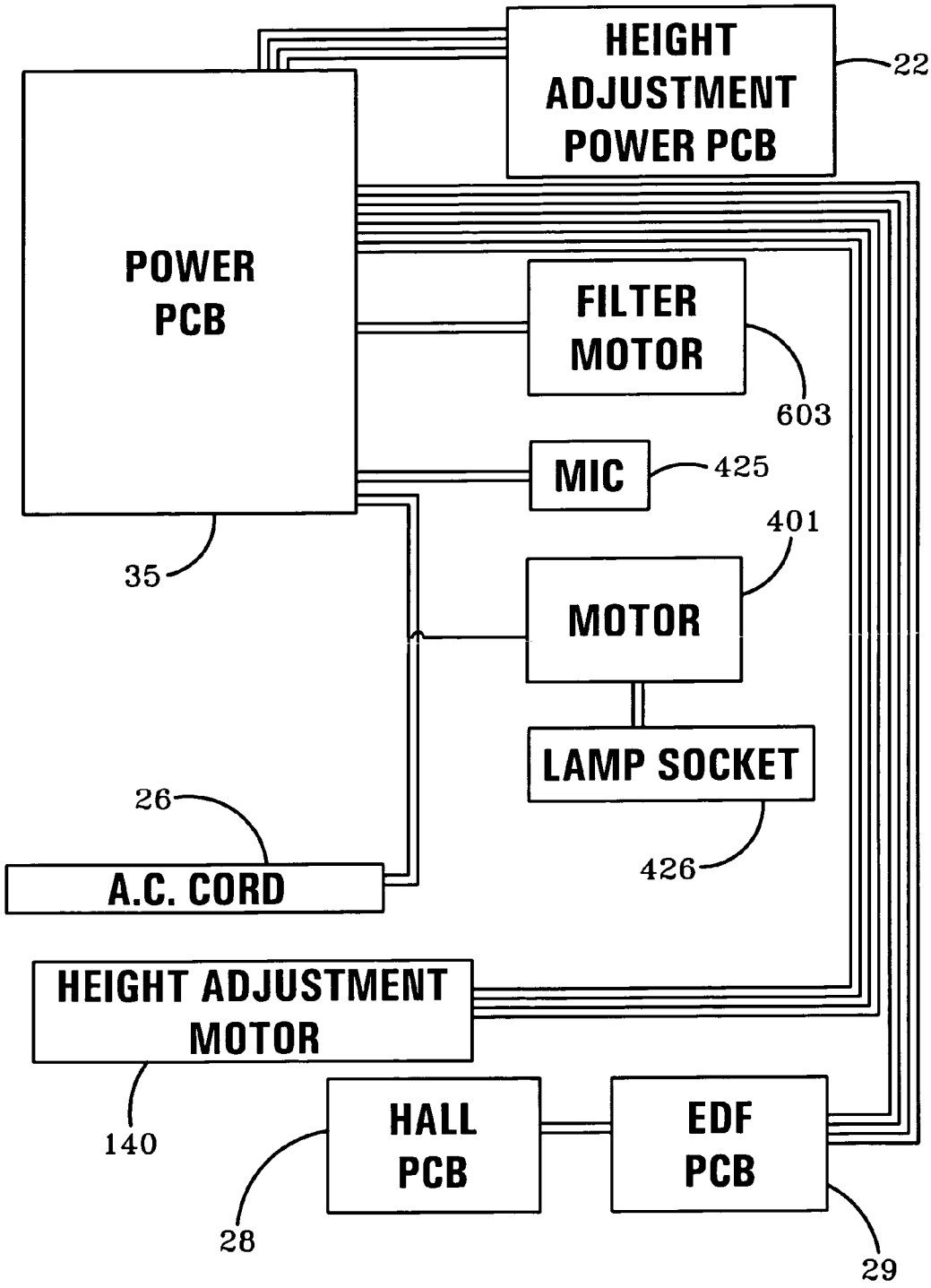
FIG. 5 is a block diagram of the electrical system of the vacuum cleaner of FIG. 1, according to the preferred embodiment of the present invention.

Referring now to FIG. 5, shown is a block diagram of the electronic components and wiring of the electrical system for the subject vacuum cleaner 10 (FIG. 1). An electrical power cord 26 provides ordinary household alternating current to a power printed circuit board 35 (also shown in FIG. 2) which distributes electrical power to the various electrical components. The power printed circuit board 35 distributes power to a height adjustment power printed circuit board 22 (also shown in FIG. 2) containing the potentiometer 23 for sending a signal of varying magnitude to the control board 35 to adjust the suction nozzle height via suction nozzle height adjustment motor 140 and power switch 24 for turning the motor-fan assembly 401 on and off. The power printed circuit board 35 also provides power to the filter motor 603, a microphone 425 for detecting dirt particles removed from the floor surface, a printed circuit board for an electronic dirt finder system (EDF) 29, and a printed circuit board 28 for a hall effect sensor used to detect the stall of the rotary agitator 135 (FIG. 3) if obstructed. The printed circuit board for an electronic dirt finder system (EDF) 29 could be installed beneath the recess 191 (FIG. 3) containing the visual indicators for detecting the removal of dirt particles and when the carpet or surface has been cleaned of dirt particles. Such en electronic dirt finder system was disclosed in U.S. Pat. No. 5,608,944, owned by a common assignee and incorporated by reference as if fully rewritten herein. The hall effect sensor circuit board 28 could be located on base 110 in proximity to the suction nozzle 130 (FIG. 3). A lamp socket 426 is located or near motor-fan assembly 401 for receiving a lamp for lighting the path in front of vacuum cleaner 10 (FIG. 1). The lamp socket 401 is electrically connected to and receives power from motor-fan assembly 401. The height adjustment printed circuit board 22 could include a microprocessor (not shown) that could be pre-programmed with the various height and power settings for the suction nozzle height adjustment motor 140 and the motor-fan assembly 401.

Accordingly, the mode control arrangement for a floor care appliance is simplified, provides an effective, inexpensive, and efficient arrangement which achieves all of the enumerated objectives. While there has been shown and described herein a single embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

The invention claimed is:

1. A mode control arrangement for a floor care appliance, comprising:

a suction nozzle for cleaning a surface, said suction nozzle being capable of being moved from a first position in highest relation to a surface to be cleaned to a second position in closest relation to the surface to be cleaned or one or more positions somewhere in between said first and second positions;

a rotary mode control member having a first and second position representing the height of said suction nozzle, wherein said first position represents said first position of said suction nozzle and the second position represents said second position of said suction nozzle and said rotary mode control member could include one or more positions between said first and second positions wherein said one or more positions represent a position of said suction nozzle located in between said first and second positions of said suction nozzle;

a suction nozzle height adjustment motor electronically controlled by said rotary mode control member;

a rotary agitator;

a rotary power source;

a belt for transmitting rotary power from said rotary power source to said rotary agitator;

an idler arm capable of being moved from a first position to a second position, a belt tensioner located on said idler arm wherein said belt tensioner tensions said drive belt when said idler arm is moved into said first position and de-tensions said drive belt when said idler arm is moved into said second position;

wherein a projection on said suction nozzle height adjustment motor engages said idler arm to move said idler arm between said first and second positions when said rotary mode control member is moved to one of said first and second positions or to one of said one or more positions between said first and second positions.

2. The mode control arrangement for a floor care appliance of claim 1, wherein said first position of said suction nozzle is for cleaning hard or bare floors and said projection on said suction nozzle height adjustment motor moves said idler arm into said first position to de-tension said drive belt transmitting rotary power from said rotary power source to said rotary agitator.

3. The mode control arrangement for a floor care appliance of claim 1, wherein said second position of said suction nozzle is for cleaning carpet of deep pile height and said projection on said suction nozzle height adjustment motor does not engage said idler arm and said idler arm is biased into a second position and drive belt is tensioned for transmitting rotary power from said rotary power source to said rotary agitator.

4. The mode control arrangement for a floor care appliance of claim 1, wherein said rotary power source is a motor-fan assembly which also provides the suction for generating a dirt laden air stream originating at said suction nozzle.

5. The mode control arrangement for a floor care appliance of claim 1, wherein said suction nozzle height adjustment motor includes a cam portion wherein said projection extends from for engaging said idler arm when said suction nozzle is moved to said second position.

6. The mode control arrangement for a floor care appliance of claim 1, wherein said cam portion engages a lever arm extending from a wheel carriage for raising and lower said suction nozzle between said first and second positions and said one or more positions between said first and said second positions.

7. The mode control arrangement for a floor care appliance of claim 1, wherein moving said rotary control member to said first position moves said suction nozzle to said first position for cleaning deep pile carpets and moving said rotary control member to said second position moves said suction nozzle to said second position to clean hard or bare floors, and wherein said positions of said rotary control member in between said first and second positions could represent predetermined heights of the suction nozzle for cleaning predetermined carpets of a specific pile height.

8. The mode control arrangement for a floor care appliance of claim 1, wherein said rotary mode control member is operatively connected to a microprocessor pre-programmed with data for controlling the suction nozzle height adjustment motor for moving said suction nozzle between said first and said second positions or said one ore more positions between said first and second positions.

* * * * *